US012434802B2

(12) United States Patent
Levi

(10) Patent No.: US 12,434,802 B2
(45) Date of Patent: Oct. 7, 2025

(54) SHIP CONSTRUCTION AND PROPULSION SYSTEM

(71) Applicant: Avraham Y. Levi, Eagan, MN (US)

(72) Inventor: Avraham Y. Levi, Eagan, MN (US)

( * ) Notice: Subject to any disclaimer, the term of this patent is extended or adjusted under 35 U.S.C. 154(b) by 390 days.

(21) Appl. No.: 18/204,899

(22) Filed: Jun. 1, 2023

(65) Prior Publication Data

US 2023/0391436 A1 Dec. 7, 2023

Related U.S. Application Data

(60) Provisional application No. 63/347,844, filed on Jun. 1, 2022.

(51) Int. Cl.

| | |
|---|---|
| ***B63H 11/10*** | (2006.01) |
| ***B63B 3/40*** | (2006.01) |
| ***B63H 11/08*** | (2006.01) |

(52) U.S. Cl.

CPC ..... *B63H 11/10* (2013.01); *B63B 3/40* (2013.01); *B63H 11/08* (2013.01)

(58) Field of Classification Search

CPC ..... B63H 11/00; B63H 11/02; B63H 11/04; B63H 11/08; B63H 2011/08; B63H 11/10; B63H 11/103; B63H 11/107; B63H 3/00; B63H 3/14; B63H 3/40; B63H 3/70

USPC ..... 440/38, 40, 47, 49, 67, 68, 84

See application file for complete search history.

(56) References Cited

U.S. PATENT DOCUMENTS

| | | | | |
|---|---|---|---|---|
| 4,363,630 | A | 12/1982 | Di Vigano | |
| 5,280,761 | A | 1/1994 | Karafiath et al. | |
| 9,327,812 | B2 | 5/2016 | Kim | |
| 2020/0324865 | A1* | 10/2020 | Al-Saedi | B63H 25/46 |

* cited by examiner

*Primary Examiner* — Daniel V Venne

(74) *Attorney, Agent, or Firm* — Bradley J. Thorson; DeWitt LLP

(57) ABSTRACT

An energy efficient ship is achieved by powering the ship using at least one propulsion level, each propulsion level having large grids at the forward and stern ends of the ship and side channels incorporating turbines that move water through the ship, rather than around the ship, thereby substantially eliminating energy wasting wakes and cavitation.

20 Claims, 5 Drawing Sheets

SHIP CONSTRUCTION AND PROPULSION SYSTEM

CROSS-REFERENCE TO RELATED APPLICATIONS

This application is a non-provisional application of Application No. 63/347,844, filed Jun. 1, 2022, and claims priority from that application which is also deemed incorporated by reference in its entirety in this application.

STATEMENT REGARDING FEDERALLY SPONSORED RESEARCH OR DEVELOPMENT

Not applicable

BACKGROUND OF THE INVENTION

I. Field of the Invention

This invention relates generally to ship building and propulsion systems for ships. More specifically, this invention relates to ship designs and ship propulsion systems adapted to reduce wake generation and cavitation and thereby reduce the energy required for a ship to move through water at sustained and reasonable velocities.

II. Discussion of the Prior Art

Historically, ship design and construction have been based on a common concept. The front of ships, known as the bow, have been pointed to split the water when sailing. To reduce the total ship resistance and improve propeller efficiency and cavitation performance due to thrust loading on the propeller of a ship, bulbous bows are sometimes attached to a ship as described in U.S. Pat. No. 5,280,761 granted to Karafiath et al. on Jan. 25, 1994. The rear of a ship, i.e., the stern, is usually flat. Suggestions have been made in the past to alter the shape of the stern adjacent to the propellers of a ship for guiding the flow of water relative to the advancing hull toward a propeller when the ship is under way. See, example, U.S. Pat. No. 4,363,630 granted to Di Vigano on Dec. 14, 1982. Various arrangements have been described for reducing the sound signature resulting from cavitation generated by spinning propeller blades. Such solutions have typically involved locating the propeller in a housing with the inside of housing being provided with a plurality of baffles or resonant barrels to dampen sound waves generated by rotation of the propeller. See, e.g., U.S. Pat. No. 9,327,812 granted to Kim on May 3, 2016.

The inefficiency of the current ship designs and propulsion systems is evident by the wake generated on the sides and behind the ship as it sails, and the water turbulence in its path and at the stern. The amount of energy consumed generating these water impacts is very significant and can be substantially reduced if the ship is constructed in accordance with the present invention.

SUMMARY OF THE INVENTION

Ships made in accordance with the present invention are adapted to travel through the water at sailing speed with calm water on the sides and behind, substantially reducing the energy spent generating wake and turbulence caused by a ship when the ship is constructed in accordance with prior art methods.

Ships made in accordance with the present invention provide hydrodynamic flow of water through a propulsion level. This water enters the propulsion level through a grid stretching across the bow of a ship. The bow may be flat or pointed. In either case, the bow is designed to direct water through the grid rather than create a wake. Water entering the ship through the bow's grid is received in a pair of bow chambers and then directed through port and starboard channels to stern chambers. The port and starboard channels each comprise at least one pipe and at least one turbine channel. While in the port and starboard channels, the water is accelerated by the turbines. From the stern chambers, the water then exits the ship through a second grid stretching across the stern. This design serves to virtually eliminate any wake generated by the shape of the bow and any cavitation at the rear allowing the ship to travel through the water without any substantial wasted energy.

The present invention may be implemented so that there is a plurality of propulsion levels. Each is designed as described above. When the ship is not carrying a load, only the lowest level is submerged under the water, and only the turbines of that level are energized. When the ship is partially loaded, a second level will be under the water level, and the pumps of that second level will be energized. The number of propulsion levels provided will depend on the specific ship design and the load the ship is intended to carry. The greater the displacement of the ship resulting from the design and the load carried, the greater the number of propulsion levels provided and operated to move the ship through the water.

The actual design of a ship embodying the present invention may, of course, be altered to assure stability and other design considerations as needed.

DESCRIPTION OF THE DRAWINGS

The foregoing features, objects and advantages of the invention will become apparent to those skilled in the art from the following detailed description of a preferred embodiment, especially when considered in conjunction of the accompanying drawings in which like numerals in the several views refer to corresponding parts.

DESCRIPTION OF THE PREFERRED EMBODIMENT

Figure 1:
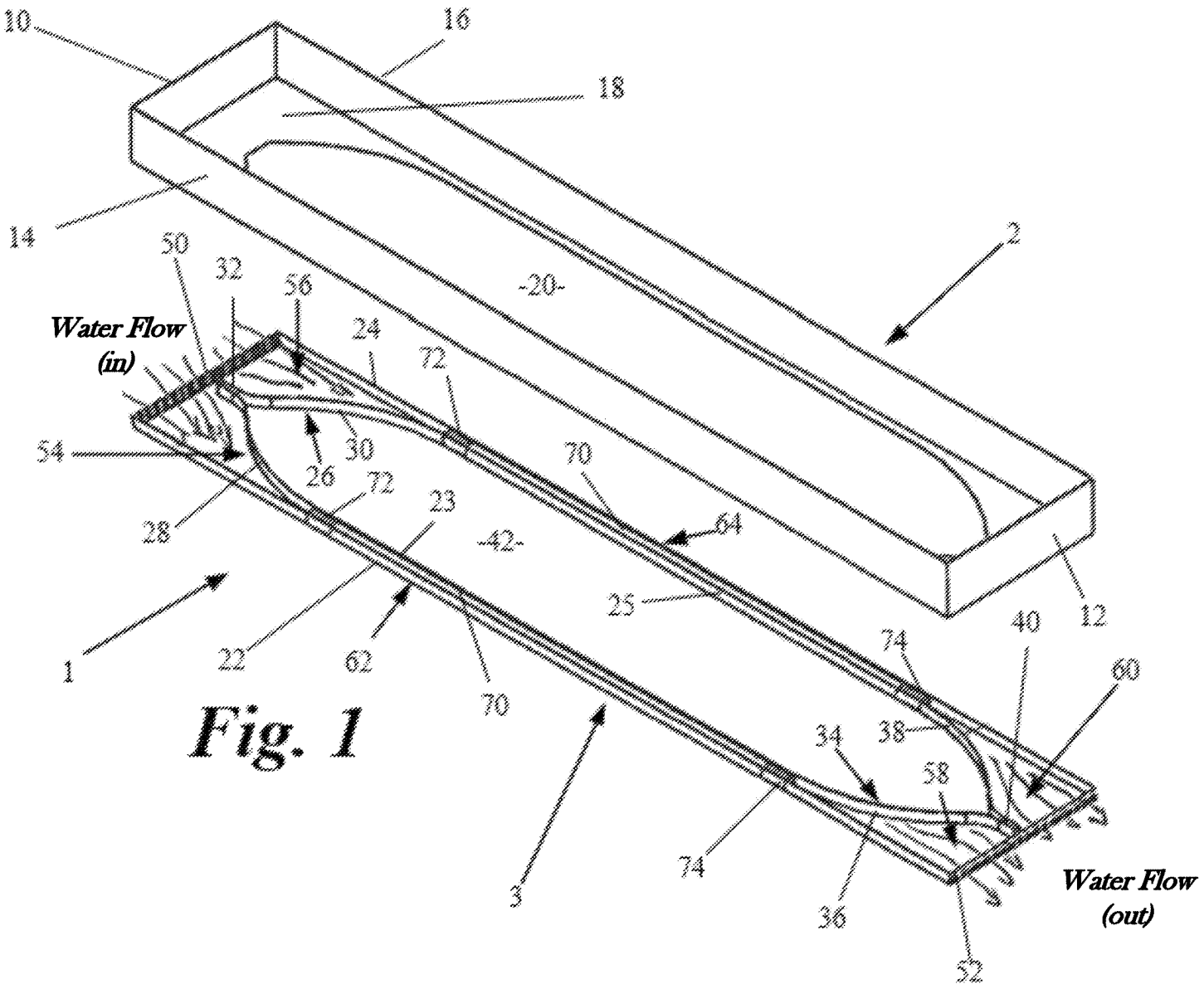
FIG. 1 is an exploded perspective view of a ship incorporating a single propulsion level adapted to reside below a main body of the ship.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

Figure 2:
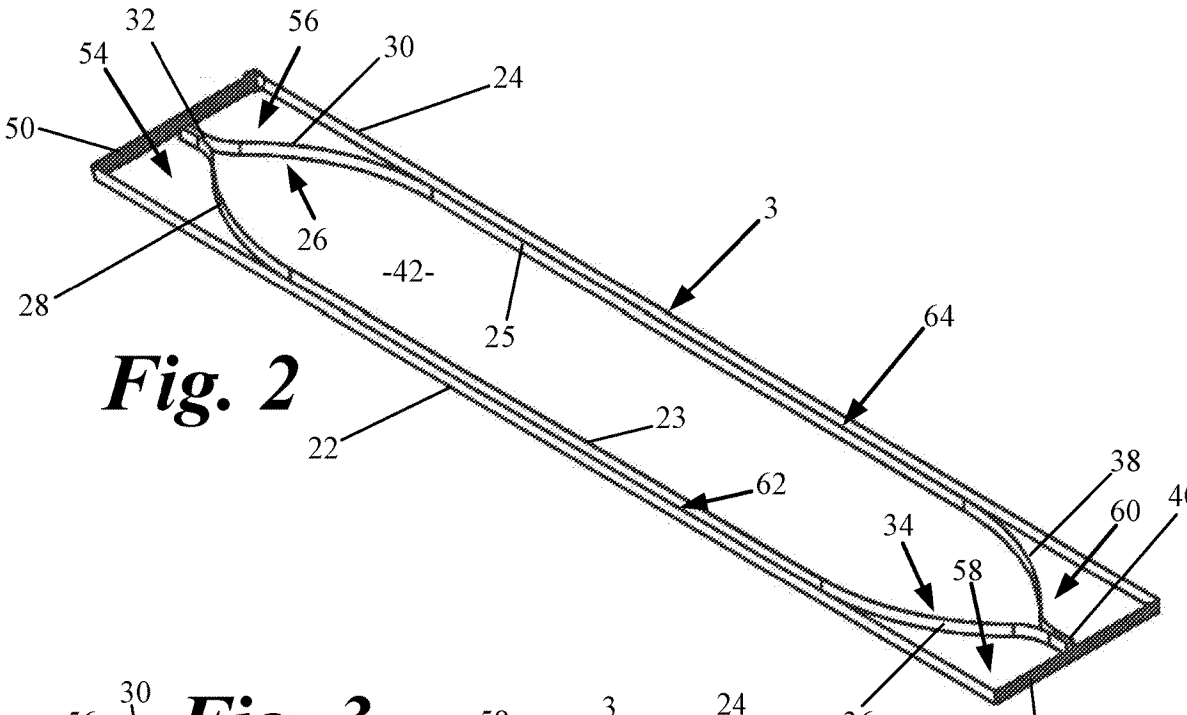
FIG. 2 is a perspective view of the propulsion level of FIG. 1.
Figure 3:
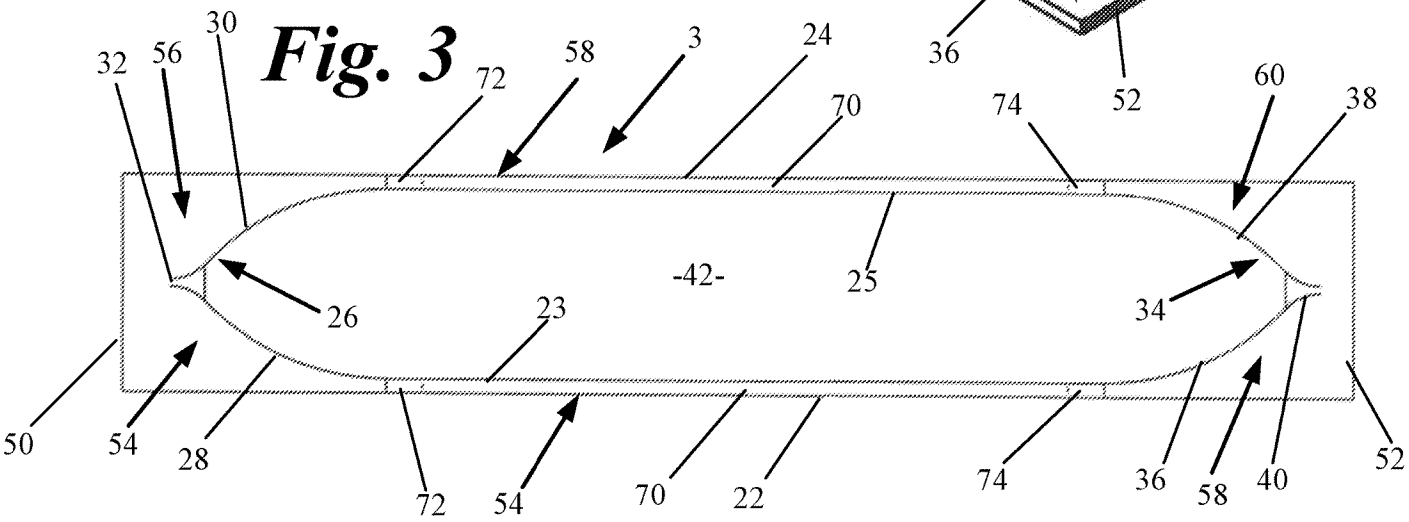
FIG. 3 is a top view of the propulsion level of FIG. 1.

FIGS. 1 through 3 show a first embodiment of hull of a ship 1 comprising a main body section 2 adapted to reside above a first propulsion level 3. The design of the main body section 2 will depend on the function of the ship. The main body section 2 of a passenger ship may be fitted with cabins, restaurants, entertainment spaces and other facilities typically found on modern cruise ships. The main body section 3 of cargo ships will be fitted in ways designed to efficiently carry cargo which may be liquids such as oil, granular material such as grain, or goods stored in shipping containers. As shown, the main body section 2 comprises a forward wall 10, a stern wall 12, a port wall 14, and a starboard wall 16. The top is open but may be covered by decking. Also, the bottom wall 18 has a large opening 20 providing access to the propulsion level 3 below.

The propulsion level 3 has an outer port wall 22, an inner port wall 23, an outer starboard wall 24, and an inner starboard wall 25. A funnel such as Y-shaped forward wall 26 connects the forward ends of the inner port and inner starboard walls 23/25. More specifically, the arms 28 and 30 of forward wall 26 connect the forward ends of the inner port and inner starboard walls 23/25 while the leg 32 extends further forward. A similar funnel such as Y-shaped stern wall 34 connects the stern ends of the inner port and inner starboard walls 23/25. More specifically, the arms 36 and 38 of stern wall 34 connect the stern ends of the inner port and inner starboard walls 23/25 while the leg 40 extends further aft. A bottom wall 42 extends the entire length of the propulsion level between the outer port wall 22 and the outer starboard wall 24.

Extending between the forward ends of the outer port wall 22 and the outer starboard wall 24 is a forward grid 50. A stern grid 52 extends between the stern ends of the outer port wall 22 and the outer starboard wall 24. Two forward chambers 54 and 56 are defined by the forward grid 50, the outer port and starboard walls 22/24, and the Y-shaped forward wall 26. Two stern chambers 58 and 60 are defined by the stern grid 52, the outer port and starboard walls 22/24, and the Y-shaped stern wall 34. A port channel 62 located between the inner and outer port walls 22/23 extends between forward chamber 54 and stern chamber 58. Starboard channel 64 located between the inner and outer starboard walls 24/25 extends between the forward chamber 56 and stern chamber 60. The port and starboard channels 62 and 64 each comprise a pipe 70 and are each in fluid communication with at least one motor driven turbine 72. In the drawings, two such motor driven turbines 72 and 74 are coupled to each of pipes 70. The motors of the motor driven turbines 72/74 may be electric motors, hydraulic motors, or internal combustion engines. No matter the type of motors used, the motors should be variable speed motors. The motors should also be adapted to spin the turbines in either direction so that the speed and direction of the turbines are individually selectable.

When the turbines 72/74 connected to each of the pipes 70 are turning, water is drawn through the forward grid 50 into the forward chambers 54 and 56. The water entering the forward chambers 54 and 56 is then forced through the associated port and starboard channels 62 and 64 by the turbines 72/74, exiting the channels 62 and 64 into the stern chambers 58 and 60, and ultimately exiting the ship through the stern grid 52. As the ship moves through the water, virtually no appreciable wake is created and there is minimal cavitation or churning of water at the rear such that energy applied moves the ship rather than creating unnecessary turbulence in the surrounding water. Energy efficiency may be further enhanced by proper shaping of the chambers, pipes, turbine blades, and walls forming the grids. The speed of the ship may be regulated either by controlling the speed at which the turbines spin or by providing port and starboard channel valves 78 adapted to control the rate of flow through the port and starboard channels 62/64. The valves of the propulsion system may be either hydraulically or electrically controlled valves having positions infinitely variable between their open and closed positions.

Steering may also be provided or assisted by regulating flow through the individual channels. For example, if flow is greater through the port channel 62 than the starboard channel 64, the ship will turn to toward the starboard side, and if flow is greater through the starboard channel 64 than through the port channel 62, the ship will turn toward the port side. Flow through the individual channels may be regulated by providing channel regulating valves 78, or by adjusting the speed at which the turbines 72 and 74 operate. Turning of the ship may be expedited by turning off or reversing the direction the turbines associated with one side of the ship are spinning. If the turbines of the port channel 62 are spinning in the opposite the direction the turbines of starboard channel 64 are spinning, water will flow through the channels 62 and 64 in opposite directions causing the ship to turn.

Likewise, steering may be controlled by providing separate tubes (jets) 80 near both the forward and stern ends of the channels 62 and 70 which extend through the outer port and outer starboard walls 22/24. Diverter valves 82 may be provided to selectively divert selectable proportions of the channel's flow through these tubes. Controlling the valves so that water flows through a forward tube exiting the starboard side of the ship and a stern tube existing the port side of the ship will turn the ship toward the port side. Likewise, controlling the valves so that water flows through a forward tube exiting the port side of the ship and a stern tube exiting the starboard side of the ship will turn the ship toward the starboard side. Such tubes may also be used to move the ship sideways through the water, such as when docking by allowing water to flow out the stern and forward tubes on the same side (port or starboard) of the ship. For example, the ship, when parallel to a dock on the ship's port side, may be moved closer to the dock by controlling the valves so water exits the ship through the jets on the starboard side. The ship may likewise be moved away from the dock by controlling the valves, so water exits the ship through the jets on the port side. The ship may be held parallel to the dock or turned away from the dock during such operations by altering the quantity of water exiting the jets at the forward end relative to the quantity of water exiting the jets at the stern end. The valves 78 and 82, and the turbines 72 and 74 may be an individually computer-based controller 90 comprising a processor, clock, memory, storage, interface cards, and a user interface comprising a display and one or more input devices. The controller 90 is under program control and sends individual control outputs to the individual valves 78/82 and individual turbines 72/74 based on feedback signals received from those devices, other sensors, other devices such as GPS and autopilot devices, and the user interface.

The arrangement described above may also be employed to move the ship either forward or backward with equal efficiency since the propulsion level 3 is symmetrical. To reverse the direction of travel of the ship, the direction in which the turbines are spinning is simply reversed.

Figure 4:
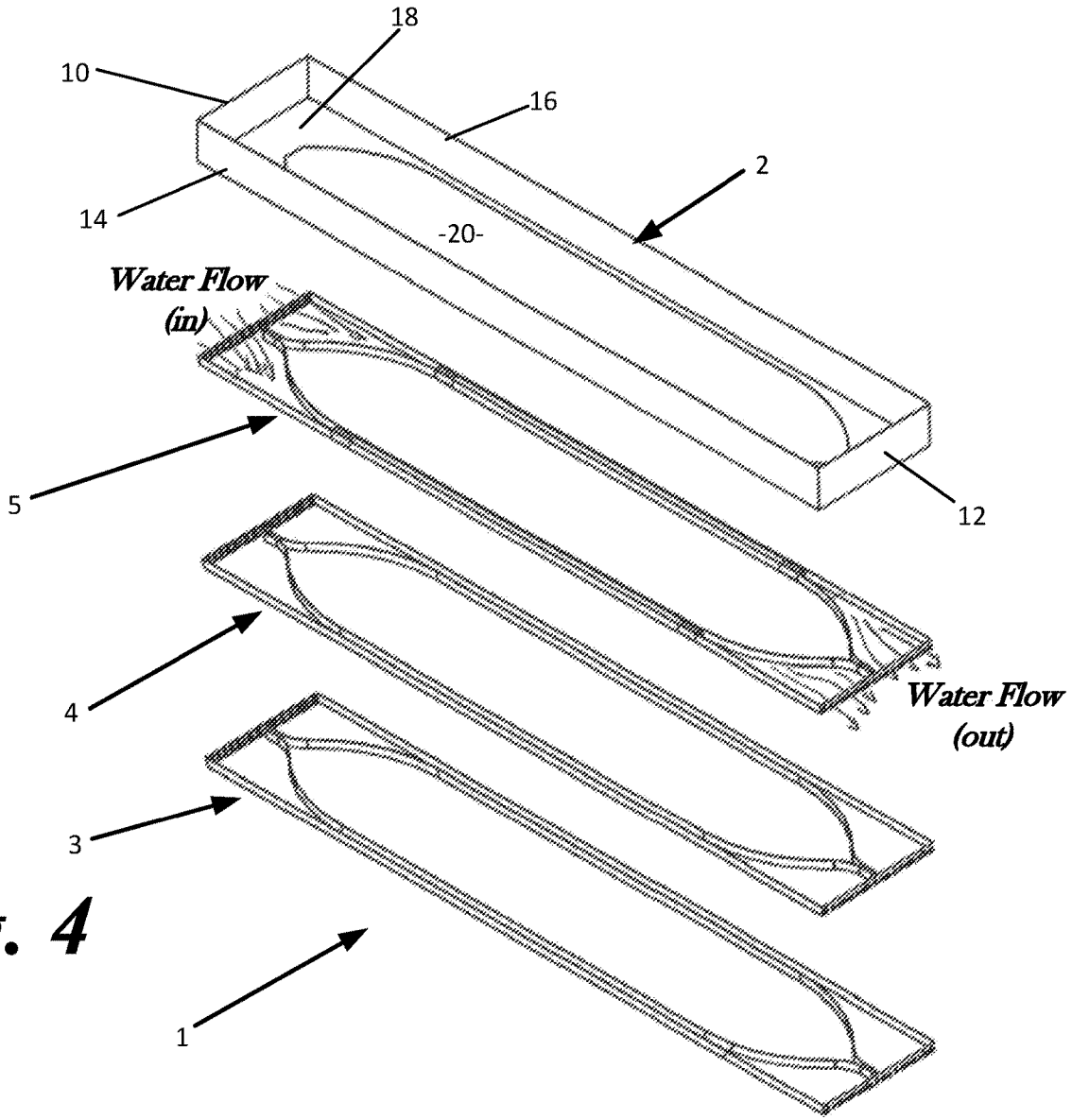
FIG. 4 is an exploded perspective view of an alternative embodiment comprising three propulsion levels adapted to reside below a main body of a ship.
Figure 5:
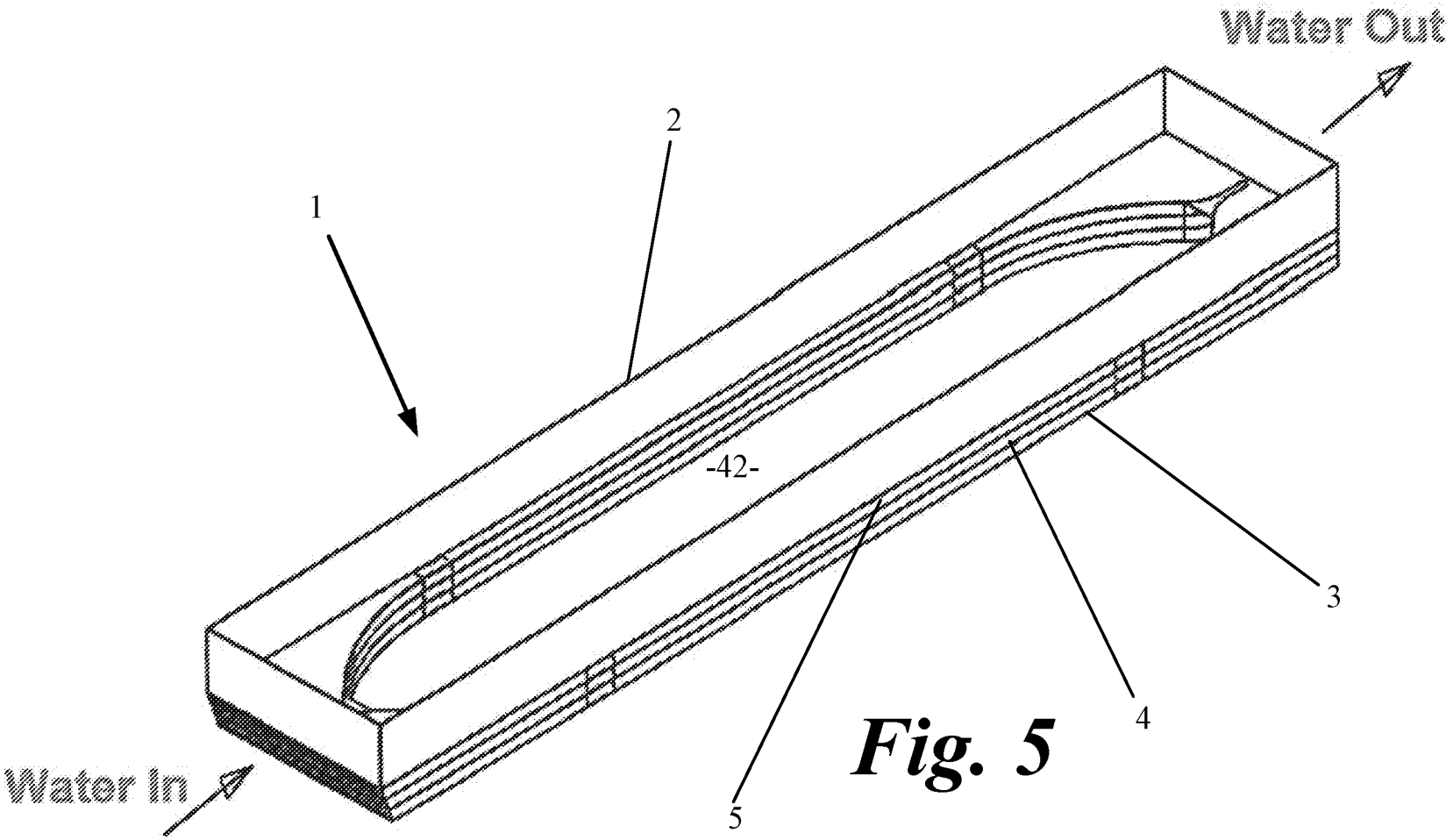
FIG. 5 is a perspective view of the alternative embodiment of FIG. 4.
Figure 6:
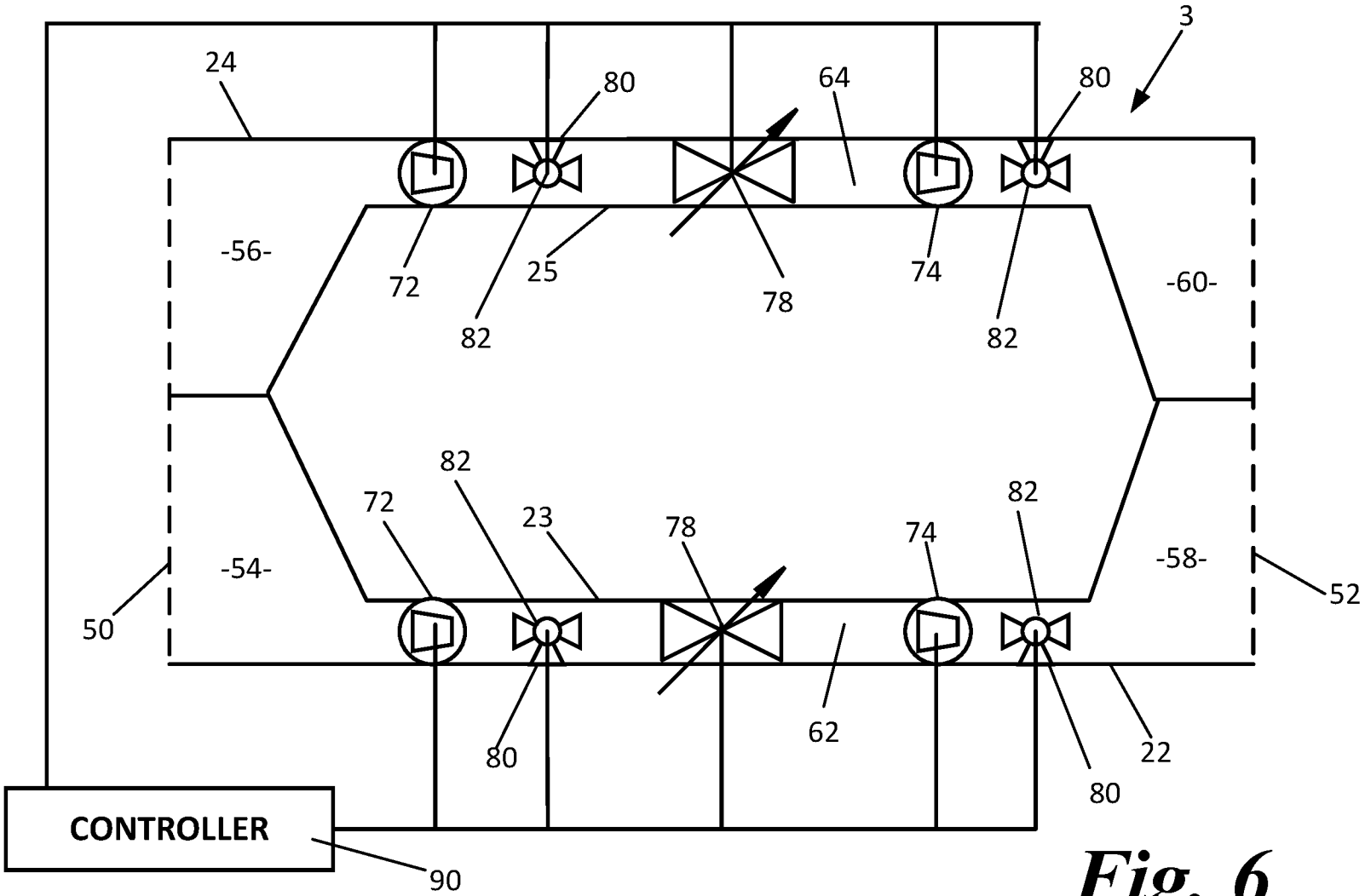
FIG. 6 is a schematic diagram of the hydraulic components used to control the speed and direction of the ship.

FIGS. 4 and 5 show an alternative embodiment in which the ship comprises a main body section 2 adapted to reside above a first propulsion level 3 and two additional (second and third) propulsion levels 4 and 5 sandwiched between the first propulsion level 3 and the main body section 2. The second and third propulsion levels 4 and 5 have all the same attributes as the first propulsion level other than they are open to the lower level(s) providing a clear space above the bottom wall 42 of the first propulsion level 3 between the inner port and starboard walls 23/35 and the Y-shaped forward and stern walls 26/34. The turbines of these propulsion levels can be selectively operated depending upon the displacement of the ship and the conditions of the sea. More specifically, the second and third propulsion levels 4 and 5 will be selectively engaged and operated only when the load carried by the ship causes the grids of these levels to be submerged beneath the water's surface.

Various modifications may be made without deviating from the present invention. For example, more than three propulsion levels may be provided. Likewise, the ship made in accordance with the present invention will typically include stabilizing structures such as a keel, ballast, fins, wings, or rotors. The funnel may also include additional baffles to effectively and efficiently direct water to and from the port channel 62 and starboard channel 64. The ship may, under certain circumstances, be sufficiently or further stabilized by varying flow through the respective port and stern channels 62 and 64 while relying on a rudder to steer. Doors may be provided to control the amount of water entering or exiting through the grids. Piping may also be provided to place vertically adjacent chambers of a ship having a plurality of propulsion levels in fluid communication with each other. Such doors and piping may be deployed to enable use even the turbines of propulsion levels above the waterline to help propel the ship.

The invention claimed is:

1. A ship comprising a main body portion carried by at least one propulsion level, said propulsion level comprising a port forward chamber, a port stern chamber, a port channel extending between the port forward chamber and the port stern chamber, a starboard forward chamber, a starboard stern chamber, a starboard channel extending between the starboard forward chamber and the starboard stern chamber, a forward grid structure and a stern grid structure, at least one port turbine positioned between the forward grid structure and the stern grid structure and adapted to cause fluid to flow along a first path through the forward grid structure, the port forward chamber, the port channel, the port stern chamber and the stern grid structure, and at least one starboard turbine positioned between the forward grid structure and the stern grid structure and adapted to cause fluid to flow along a second path through the forward grid structure, the starboard forward chamber, the starboard channel, the starboard stern chamber and the stern grid structure.

2. The ship of claim 1 wherein the at least one starboard turbine and the at least one port turbine are each adapted to rotate at individually selectable variable speeds.

3. The ship of claim 2 wherein the least one starboard turbine and the at least one port turbine are further adapted to operate in individually selectable variable directions.

4. The ship of claim 1 further comprising at least one port jet extending from the port channel, at least one port diverter valve adapted to selectively control flow though said at least one port jet, at least one starboard jet extending from the starboard channel, and at least one starboard diverter valve adapted to selectively control flow though said at least one starboard jet.

5. The ship of claim 1 further comprising at least one port channel regulating valve adapted to cooperate with the at least one port turbine to control flow fluid along the first path, and at least one starboard channel regulating valve adapted to cooperate with the at least one starboard turbine to control flow fluid along the second path.

6. The ship of claim 1 further comprising inner and outer port walls surround the port channel, inner and outer starboard walls surround the starboard channel, and first and second funnels extending between the inner port wall and the inner starboard wall, and wherein said forward grid structure and said stern grid structure each extend between the outer port wall and the outer starboard wall.

7. The ship of claim 6 wherein each of said funnels comprises a Y-shaped wall.

8. A ship comprising a main body portion carried by a plurality of separately operable propulsion levels, each of said plurality of propulsion levels comprising a port forward chamber, a port stern chamber, a port channel extending between the port forward chamber and the port stern chamber, a starboard forward chamber, a starboard stern chamber, a starboard channel extending between the starboard forward chamber and the starboard stern chamber, a forward grid structure and a stern grid structure, at least one port turbine positioned between the forward grid structure and the stern grid structure and adapted to cause fluid to flow along a first path comprising the forward grid structure, the port forward chamber, the port channel, the port stern chamber and the stern grid structure, and at least one starboard turbine positioned between the forward grid structure and the stern grid structure and adapted to cause fluid to flow along a second path comprising the forward grid structure, the starboard forward chamber, the starboard channel, the starboard stern chamber and the stern grid structure.

9. The ship of claim 8 wherein the at least one starboard turbine of each of said plurality of propulsion levels and the at least one port turbine of each of said plurality of propulsion levels are adapted to rotate in an individually selectable directions and at individually selectable variable speeds and thereby assist with controlling the speed and direction of the ship.

10. The ship of claim 8 wherein each of said plurality of propulsion levels further comprises at least one port jet extending from the port channel, at least one port diverter valve adapted to selectively control flow though said at least one port jet, at least one starboard jet extending from the starboard channel, and at least one starboard diverter valve adapted to selectively control flow though said at least one starboard jet.

11. The ship of claim 8 wherein each of said plurality of propulsion levels further comprises at least one port channel regulating valve adapted to cooperate with the at least one port turbine to control flow fluid along the first path, and at least one starboard channel regulating valve adapted to cooperate with the at least one starboard turbine to control flow fluid along the second path.

12. The ship of claim 8 wherein each of said plurality of propulsion levels further comprises inner and outer port walls surrounding the port channel, inner and outer starboard walls surrounding the starboard channel, and first and second funnels extend between the inner port wall and the inner starboard wall, and wherein said forward grid structure and said stern grid structure each extend between the outer port wall and the outer starboard wall.

13. The ship of claim 12 wherein each of the first and second funnels comprise a Y-shaped wall.

14. A ship comprising a main body portion carried by a propulsion level, said propulsion level comprising inner and outer port walls, each having a forward end and a stern end, surrounding a port channel, inner and outer starboard walls, each having a forward end and a stern end, surround a starboard channel, at least one port turbine in fluid communication with the port channel, at least one starboard turbine in fluid communication with the starboard channel, said inner port wall and said inner starboard wall joined together at their forward ends by a first funnel and at their stern ends by a second funnel, said outer port wall and said outer starboard wall joined together at their forward ends by a forward grid and at their stern ends by a stern grid, wherein first and second forward chambers are defined by the forward grid, the outer port wall, the outer starboard wall and the first funnel, first and second stern chambers are defined by the stern grid, the outer port wall, the outer starboard wall and the second funnel, and wherein the port channel extends between the first forward chamber and the first stern chamber, and said starboard channel extends between said second forward chamber and said second stern chamber.

15. The ship of claim 14 further comprising at least one additional propulsion level positioned between the main body portion and propulsion level.

16. The ship of claim 14 wherein the propulsion level is adapted so that when the turbines are turning in a first direction, water is drawn through the forward grid into the first and second forward chambers and through the associated port and starboard channels exiting the port and starboard channels into the first and second stern chambers and through the stern grid to propel the ship.

17. The ship of claim 14 wherein each of the first funnel comprises a Y-shaped forward wall, and the second funnel comprises a Y-shaped stern wall.

18. The ship of claim 14 further comprising at least one port jet extending through the outer port wall and at least one port diverter valve adapted to control flow though said at least one port jet.

19. The ship of claim 14 further comprising at least one starboard jet extending through the outer starboard wall and at least one starboard diverter valve adapted to control flow though said at least one starboard jet.

20. The ship of claim 14 further comprising at least one starboard channel regulating valve and at least one port channel regulating valve.

* * * * *